United States Patent [19]

De Simone

[11] 4,187,570

[45] Feb. 12, 1980

[54] SHIP ESCAPE AND SURVIVAL SYSTEM

[75] Inventor: David N. De Simone, Cornwells Heights, Pa.

[73] Assignee: The United States of America as represented by the Secretary of the Navy, Washington, D.C.

[21] Appl. No.: 878,556

[22] Filed: Feb. 17, 1978

[51] Int. Cl.[2] ..... B63C 9/00

[52] U.S. Cl. ..... 9/14; 244/138 R; 9/4 R; 9/11 A

[58] Field of Search ..... 9/4 R, 4 A, 2 A, 11 A, 9/30–33, 14, 1.5; 114/71; 244/138 R; 182/5, 6, 7

[56] References Cited

U.S. PATENT DOCUMENTS

| | | | |
|---|---|---|---|
| 1,123,645 | 1/1915 | Aaron | 9/30 |
| 1,852,887 | 4/1932 | Lossius | 182/7 |
| 2,758,887 | 8/1956 | Herod | 182/5 |
| 3,058,127 | 10/1962 | Endrass | 9/11 A |
| 3,760,901 | 9/1973 | Hynes | 182/7 |
| 3,768,761 | 10/1973 | Cramer | 244/138 R |
| 3,880,255 | 4/1975 | Huntley | 182/5 |

*Primary Examiner*—Charles E. Frankfort
*Assistant Examiner*—D. W. Keen
*Attorney, Agent, or Firm*—R. S. Sciascia; Henry Hansen

[57] ABSTRACT

A personnel evacuation and survival device for individual crewmen aboard ship having a quick don harness to which is attached a personnel lowering device and an automatically deployable encapsulating life raft. From an appropriate evacuation station aboard the ship, the crewman uses the device to suspend himself clear of the side and lower himself on a lifeline, the pay-out of which is controlled to provide a safe rate of descent. During the descent, a raft package is automatically released and a life raft is inflated which completely encapsulates the crewman prior to water entry.

17 Claims, 5 Drawing Figures

SHIP ESCAPE AND SURVIVAL SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to life-saving and survival equipment and in particular to a personnel evacuation and anti-exposure device for use by individual crewmen in abandoning a ship in distress.

Cold water shipping operations present unique problems of crew safety and survival in time of disaster. Although it is a relataively simple task to provide the crewmen with devices to prevent drowning, it is most difficult to combat the more severe hazards of cold air exposure and cold water immersion which induce dangerously subnormal body temperatures. Deaths due to cold, rather than drowning, are well documented in maritime history because the water's ability to conduct away body heat causing hypothermia is most efficient, survival time being in terms of minutes. Thus, an inflatable anti-exposure life raft combined with a means for safe rapid escape from an endangered vessel is of prime importance for crew survival in a frigid sea and air environment.

Existing protective equipment does not adequately meet these needs for crewmen escape and survival. For purposes of escape, various types of ramps and slides have been employed, while for survival purposes, many inflatable life rafts have been developed. Although such devices have served their purposes, they have not proven entirely satisfactory under frigid sea conditions for the reasons that difficulties have been experienced in their storage and maintenance as a result of bulky sizes and a frequent need for inspection and in the limited protection afforded by them against cold air exposure and cold water immersion.

SUMMARY OF THE INVENTION

Accordingly, it is the general purpose and object of the present invention to provide a life-saving device for the personnel of a ship in distress which affords rapid yet safe escape, protection against adverse environmental conditions and detection during rescue operations. Another object is to provide a ship escape system by which personnel are transferred from the ship in distress to the water surface in a dry encapsulated state. A further object of the invention is to provide a ship escape and survival system which is easily stored and which requires little or no maintenance and inspection when not in use. Still another object is to provide shipboard survival equipment which sustains extreme weather conditions during storage, operation and subsequent rescue. A still further object of the invention is to provide a personnel survival device which is simple and reliable, which requires a minimum of user training, and which is relatively inexpensive to manufacture and fabricate.

Briefly, these and other objects of the present invention are accomplished by a personnel escape and survival device which is donned by ship personnel and which comprises a torso harness on the back of which is attached an encapsulating raft package with a self-contained inflation system and on the front of which is attached a personnel lowering device. At time of ship abandonment, the crewman attaches one end of the personnel lowering device to a life boat davit or other extandable or extended part of the ship, and once suspended clearly over the side, activates the personnel lowering device which lowers him at a safe fixed rate. During the lowering period, an encapsulating raft is automatically released and inflated, completely enclosing the crewman prior to water entry.

For a better understanding of these and other aspects of the invention, reference may be made to the following detailed description taken in conjunction with the accompanying drawing in which like reference numerals designate like parts throughout the figures thereof.

DESCRIPTION OF THE PREFERRED EMBODIMENT

Figure 1:
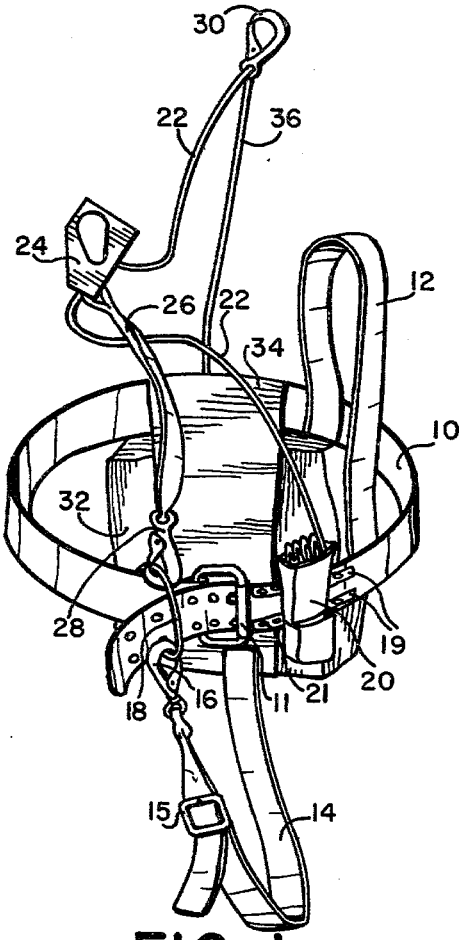
FIG. 1 represents a frontal perspective view of a personnel survival device as it would be positioned on a ship crewman just prior to its operation.
Figure 2:
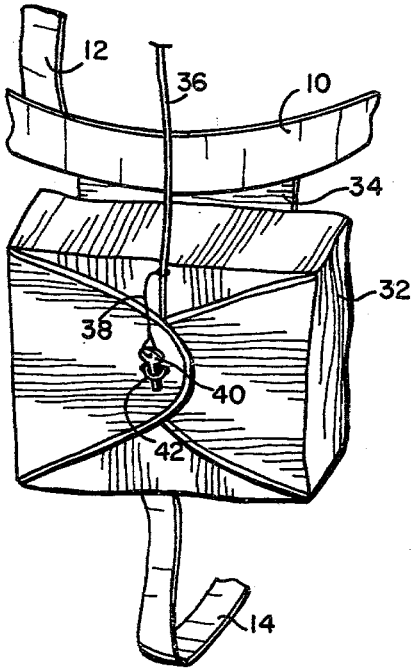
FIG. 2 represents a rear perspective view of the personnel survival device of FIG. 1 showing only a portion of the device.

Referring now to FIGS. 1 and 2 which show the preferred embodiment of the invention in an operative state but with the crewmen removed, there is shown a chest harness 10 which is to be strapped around the ship crewman's body just below the armpits. The harness 10 is fabricated from a strong, woven material, such as nylon, to support heavier weights and of sufficient width to provide comfortable distribution of the wearer's weight during escape. A buckle 11 is attached to one end of the harness 10 and serves to secure the harness in its proper position and to permit adjustment. A shoulder strap 12, formed of conventional webbing material, such as nylon, is connected to the front and rear of the chest harness 10 at a position that will not interfere with the inflation of the raft nor affect the ease of donning and doffing the harness. The shoulder strap 12 is draped over the wearer's shoulder and provides support for the weight of the enclosed raft package 32.

A back strap 34 is connected to the inside rear of the chest harness 10 and extends downward providing an area of attachment for both the raft package 32 and an adjustable bottom harness 14. Both the back strap 34 and the bottom harness 14 are fabricated from high-strength conventional webbing material, such as nylon, and together, provide support for the raft package 32 and maintain its proper attitude during deployment. One end of the bottom harness 14 is connected to the lower inside surface of the back strap 34, while the other end is terminated by a snap hook 16, which permits the wearer to manually attach the bottom harness 14 to the front of the chest harness 10. A D-shaped ring 18 is pivotally attached to the front of the chest harness 10 and provides the point of engagement for the bottom harness 14 after the bottom harness has been passed through the wearer's legs. A slide 15 is provided on the bottom harness 14 to permit adjustment of its length so that the attitude of the raft package 32 is maintained in a relatively fixed position along the wearer's back.

A lifeline pocket 20 is fabricated from a conventional duck cloth material, such as nylon, for carrying the required length of lifeline 22 and is attached to the front of the safety harness 10 by means of a pair of fastening straps 19 and sets of snap fasteners 21. The fastening straps 19, made of a similar duck cloth material as the lifeline pocket 20, are parallelly spaced and attached to the back surface of the lifeline pocket, extending equally on both sides of the pocket. The male members of the snap fasteners 21 are secured in position on the fastening straps 19 on both sides of the lifeline pocket 20, while the mating members are fixed in corresponding positions on the front of the safety harness 10. The lifeline 22, constructed of a high strength fiber, such as dacron, is packed in the lifeline pocket 20, fed through a descent governor 24 and secured to a snap hook 30. One end of a personnel attaching strap 26 is fixed to the descent governor 24 while the other end is terminated by a snap hook 28 and attached thereby to the front of the chest harness 10 at ring 18. The attaching strap 26, fabricated of conventionally processed cowhide, maintains the position of the descent governor 24 in proximity to the wearer and helps support his weight during descent. The descent governor 24 is a conventional device which controls the payout of the lifeline 22 and lowers personnel of weights ranging between 150 and 275 pounds at descent rates between 1 ft/sec and 3 ft/sec. One suitable descent governor is that manufactured by Eastern Rotocraft, No. SP3140-3. It should be noted that this range of descent rates provide a rapid, safe escape while still permitting sufficient time for complete raft encapsulation prior to water entry.

An actuating lanyard 36, which is fabricated from a conventional man-made fiber of suitable strength, such as nylon, and braided, is attached to snap hook 30 and suspends downward behind the wearer into the folded raft package 32. At a point on the actuating lanyard 36 outside of the raft package 32, one end of a length of cord 38, similar in material and construction as the lanyard, is permanently attached so that the cord extends downward substantially parallel to the lanyard. A key-shaped release pin 40 is secured to the other end of cord 38 and inserted into the exposed portion of a keeper loop 42 which passes through the aligned holes in the folding panels of raft package 32. This interaction between the release pin 40 and the keeper loop 42 maintains raft enclosure until the release pin is pulled during descent.

Figure 3:
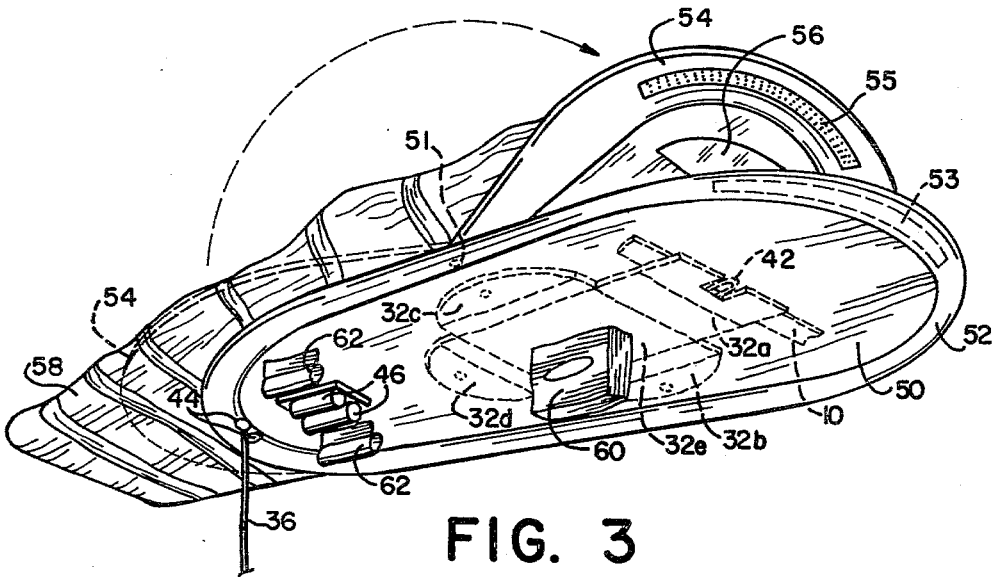
FIG. 3 is a perspective view of the encapsulating raft of the personnel survival device of FIGS. 1 and 2 with the raft unfolded and uninflated.

Referring now to FIG. 3, there is shown the raft in a partially deployed condition with the raft package 32, shown in dotted outline, released and opened and the encapsulating raft unfolded and uninflated. The panels of the raft package 32 are fabricated from a conventional duck cloth material of suitable strength and durability, such as nylon. The keeper loop 42, formed of nylon cord, is securely fastened to top panel 32*a* at a cutout along its upper edge midway between its sides. Side panels 32*b* and 32*c* and bottom panel 32*d* are similarly shaped folding members with curved outer flaps having small holes near its outer edges which align when each is folded inward. These aligned holes permit outward passage of the keeper loop 42 and proper engagement of the loop by release pin 40 when the top panel 32*a* is folded inward first. Back panel 32*e* is a non-folding member, the outside surface of which is attached to the back strap 34, while the inside surface is attached to the encapsulating raft on the inside surface of raft floor 50.

The encapsulating raft portions of the device, including the raft floor 50, lower inflation cell 52, upper inflation cell 54, ballast bag 60 and cylinder pockets 62 are of a lightweight, lowbulk, coated cloth material, such as polyurethane coated nylon, having brightly colored surfaces and unlimited shelf-life characteristics. The raft floor 50 is a flat-oval shaped member upon which the crewman wearing safety harness 10 will be supported when the raft is fully deployed and in the water. The inflatable lower flotation cell 52 is similarly oval in shape and is attached tangentially at its lower surface to the upper surface of raft floor 50 along the periphery of the raft floor. At approximately midway back from the forward edge of the lower flotation cell 52 on both sides of its upper surface, an inflatable U-shaped upper flotation cell 54 is hingedly connected near its ends to the lower cell so that when the upper cell is swung forward to a position immediately adjacent to the lower cell, the upper cell aligns with the forward section of the lower cell. At the hinged joint on the starboard side, a bidirecitonal valve 51 is installed between the two cells coupling their inner chambers so that the inflating gas passes freely between the two cells. A unidirectional check valve (not shown) is installed at the corresponding point on the port side to permit gas passage only from the upper cell 54 to the lower cell 52.

A flexible canopy 58 is fabricated from a coated cloth material of suitable strength and durability, such as rubber-coated nylon, and reinforced with strips of tape. The canopy 58 has a curved flap-like upper member and a pocket-like lower member and a total length which is slightly greater than the height of a crewman. The flap-like portion of the canopy 58 corresponds in its outline to the shape of the upper flotation cell 54 and attaches tangentially to the top surface of the upper cell. The edges of the pocket-like lower portion of the canopy 58 are bonded to the periphery of the lower location cell 52 aft of the hinged joints between the lower cell and the upper cell 54. It will be noted that when the canopy 58 is secured to the upper cell 54 and the lower cell 52 in this manner, the bottom portion of the pocket-like member extends beyond the stern of the lower flotation cell 52 and raft floor 50 to provide coverage and support for the crewman's legs upon encapsulation. A seim-circular viewport 56 of flexible transparent material, such as vinyl sheet, is installed in the area of the upper flap-like member of the canopy 58 corresponding to the crewman's head position when encapsulated thereby permitting the prone crewman to visually scan the sky for objects, such as rescue aircraft, while within the raft.

The actuating lanyard 36, shown in FIG. 2 outside of the raft package 32, further extends into the raft package to couple with the raft inflation system. A pair of detent pins (not shown) are affixed to the end of the lanyard 36 and inserted into inflation valves 44 located at the stern of the raft floor 50 on the lower inflation cell 52 adjacent to the actuating cylinders 46. The actuating cylinders 46 store pressurized gas, such as $CO_2$, and feed the inflation valves 44 from a mounted position on the bottom aft portion of the raft floor 50. Insertion of the detent pins into the inflation valves 44 contains the pressurized gas until the pins are disturbed by a pulling action upon the lanyard 36, at which time the pins are extracted and the pressurized gas is released from the cylinders. The gas flows into the lower inflation cell 52 through the inflation valve 44 on the port side of the raft and further into the upper inflation cell 54 via an internal inflation duct (not shown) which runs through the lower cell on the starboard side and the bi-directional valve 51. Inflation of the lower cell 52 is supplemented by gas flow through the upper cell 54 and the unidirectional valve (not shown) on the port side of the raft.

As the raft inflates, the upper cell 54 pivots about the hinge joints on the lower cell 52 from its uninflated position aft, shown in dotted outline, to a position substantially parallel to and touching upon the foreward portion of the lower cell. A hook and pile fastener, such as Velcro tape, includes pile fastener tape 55 on the upper cell 54 and hook fastener tape 53 on the lower cell 52, bonded in corresponding positions to the mating surfaces of the respective cells to insure clamping and to provide a seal.

A ballast bag 60, constructed of panels of the raft material having an elliptical opening on one side, is attached at its open end to the bottom of the raft floor 50 along the bow-to-stern center line slightly fore of midship. The elliptical opening on the side of the bag 60 permits the passage of water in and out of the chamber when the raft is afloat thereby improving the stability of the raft and controlling its draft. A pair of cylindrical pockets 62, angularly attached to the bottom aft of the raft floor 50 parallel to each other on the port and starboard sides, permit water passage through their chambers thereby providing the raft with a degree of directional stability.

Enclosure of the uninflated life raft within the raft package 32 is initiated by laying the raft so that the bottom of the raft floor 50 is facing upward and the canopy 58 and the upper cell 54 are beneath the raft floor 50 and the lower cell 52. The lower cell 52 with the connecting portion of canopy 58 is folded under to a position adjacent to the aft section of the upper cell 54, as shown in dotted outline, and the canopy 58 is tucked between the upper and lower cells. The raft is then folded inward from its port and starboard sides along a pair of parallel lines which correspond to the adjacent edges of the back panel 32*e*. It should be noted that the raft at this stage appears in its full length but having a folded width equivalent to the width of the back panel 32*e*, and the side panels 32*b* and 32*c* are exposed for enclosure. At this stage, the forward portion of the raft is doubly folded; first, back along the line corresponding to the top edge of the back panel 32*e* and the second, forward over itself along the line corresponding to the lower edge of the back panel. As a result of this double fold, the top panel 32*a* bearing the keeper loop 42 is exposed for raft enclosure.

The extended aft section of the uninflated raft is enfolded first, by folding the exposed portion of the canopy 58 squarely under the remaining aft section, making sure that the actuating lanyard 36 is free and unrestricted. Next, it is doubly folded; first, forward along the line corresponding to the lower edge of the back panel 32*e* and second, back over itself along the line corresponding to the top edge of the back panel, making sure that the folded canopy 58 is maintained in place and the actuating lanyard 36 remains exposed. The raft is now completely folded and neatly stacked upon the back panel 32*e* with all of the panels of the raft package exposed and ready for enclosure.

The raft enclosure sequence is as follows: first, the top panel 32*a* bearing the keeper loop 42 is closed over the folded raft and the keeper loop is projected vertically away from the folded raft; second the bottom panel 32*d* is closed over the folded raft and the top panel 32*a* and the keeper loop 42 is threaded through the hole in the bottom panel; third, the side panels 32*b* and 32*c* are closed over and the keeper loop 42 further threaded through their respective holes; finally, the release pin 40 attached to the lanyard 36 via cord 38 is inserted into the exposed portion of the keeper loop 42 thereby locking the panels in their closed positions.

Figure 5:
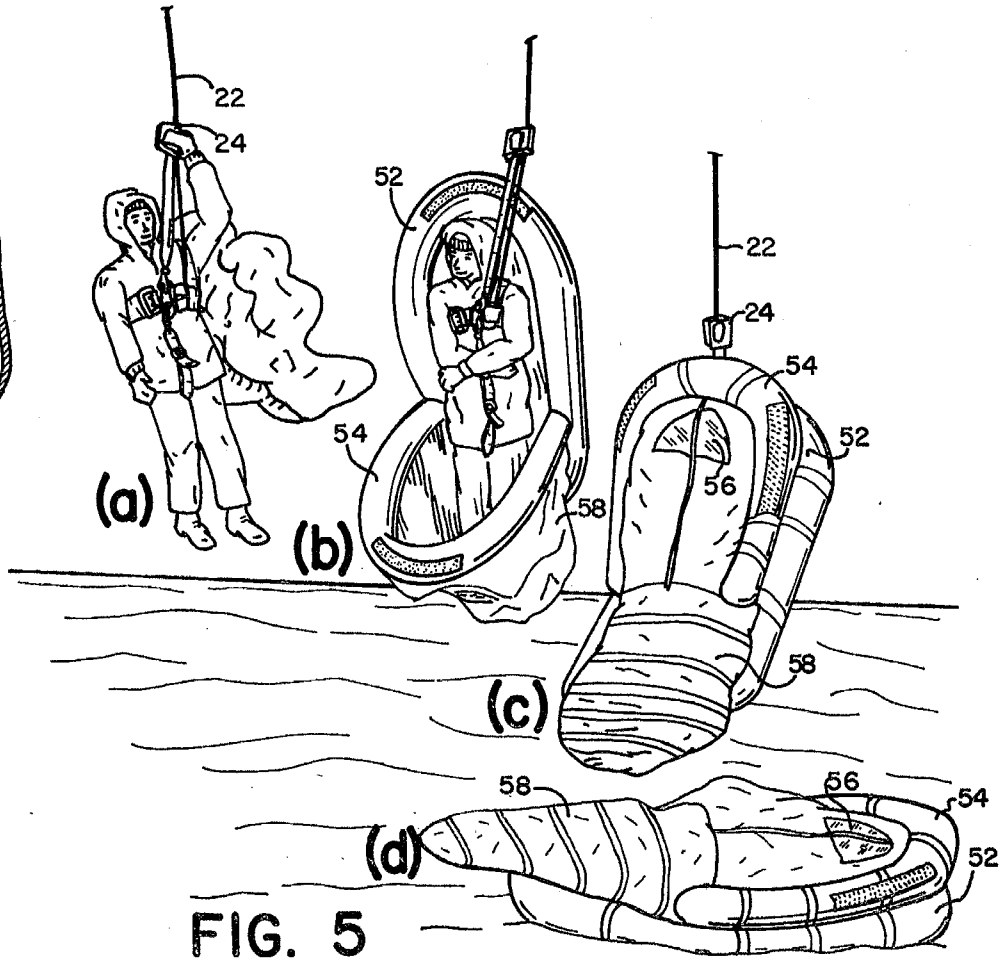
FIG. 5 is a composite representation of the sequence of operation of the personnel survival device of FIGS. 1 and 2.
Figure 4:
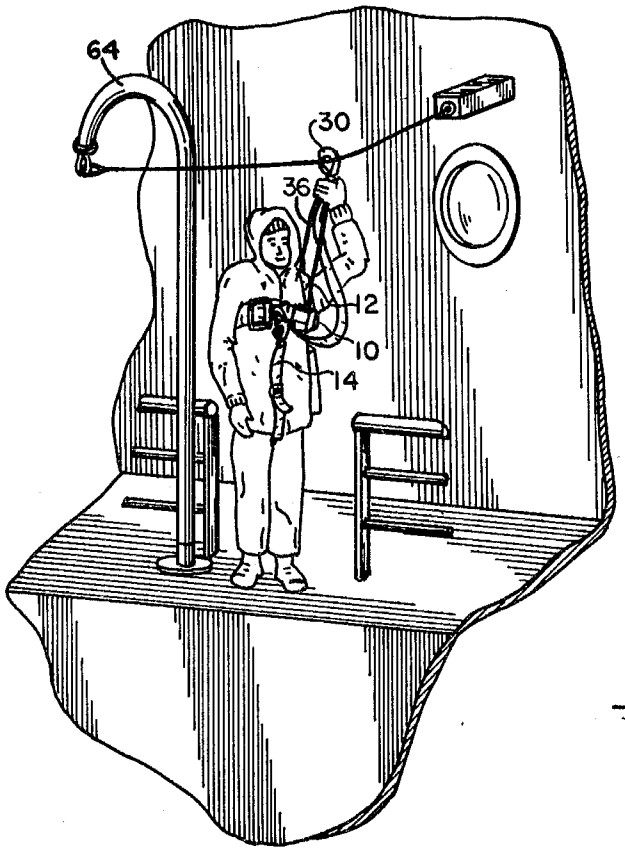
FIG. 4 shows a crewman at a ship's evacuation station with the personnel survival device of FIGS. 1 and 2 properly donned and ready for deployment.

Operation of the ship escape and survival device will now be summarized with reference to FIGS. 4 and 5, which trace the escaping crewman from the ship's deck to the water's surface. When a ship is in distress and must be abandoned, the crewman, having been distributed the survival device proceeds to an escape station with the device donned as shown in FIG. 4. The chest harness 10 is securely fastened around the crewman's body just below his armpits and its position is maintained by the shoulder strap 12. The bottom harness 14 is brought between the crewman's legs, fastened to the front of the chest harness 10 and adjusted for a snug fit. The crewman attaches snap hook 30 to an extandable or extended part of the ship, such as a life boat davit 64, and suspends himself over the side of the ship via the lifeline 22. Once suspended clearly over the side, the crewman lowers himself toward the water at a safe fixed rate using the descent governor 24 to control the payout of the lifeline 22, as shown in FIG. 5*a*. During the descent, the actuating lanyard 36 tightens and thereby opens the raft package 32 by pulling the release pin 40 from the keeper loop 42 and releases the pressurized gas into the raft cells by pulling the detent pins (not shown). The raft unfolds and the cells 52 and 54 inflate resulting in a clamping action between the two cells enclosing the crewman with his legs in the canopy 58, as shown in FIG. 5b. As shown in FIG. 5*c*, the descent governor 24 continues to feed the lifeline 22 until the crewman is afloat by which time he is completely encapsulated within the inflated cells 52 and 54 and the canopy 58. Once safely afloat, the crewman releases himself from the lifeline 22 by unsnapping the lifeline pocket 20 and unhooking the descent governor 24 from the chest harness 10. Free from the endangered vessel, as shown in FIG. 5d, the crewman is afloat, dry, and protected from the harsh environment within the fully deployed device, and can now await rescue for an extended period of time with the ability to make visual observations through the viewport 56 without exposing himself.

Some of the many advantages of the invention should now be apparent. In summary, an escape and survival device has been disclosed which is particularly suitable for individual crewman abandoning a distressed ship. The crewman is lowered from the ship at a safe fixed rate and completely encapsulated by an inflatable life raft during the descent and before water entry. In this manner, the crewman is provided with a rapid and safe means of escape and protection from the cold water immersion and cold air exposure while awaiting rescue.

Obviously, many modifications and variations of the present invention are possible in the light of the above teachings. It is therefore to be understood that, within the scope of the appended claims, the invention may be practiced otherwise than as specifically described.

What is claimed is:

1. A personnel survival system for deployment of an individual from a platform above water, comprising:
a harness formed to fit about the torso of the individual;
descent means connected to said harness for lowering the individual from the platform to the water; and
flotation means connected to said harness and including a raft having two inflatable cells angularly connected so that said cells urge against each other when inflated for sealingly encapsulating the individual during the lowering.

2. A personnel survival system as defined in claim 1, wherein said harness further comprises:
a pair of adjustable belts, one of said belts being formed to releasably fit horizontally above the waist of the individual, and the other being connected to said flotation means and formed to releasably fit vertically between the legs of the individual.

3. A personnel survival system as defined in claim 2, wherein
said harness further comprises:
a shoulder strap connected between the front and back of said horizontal belt for supporting the weight of said flotation means.

4. A personnel survival system as defined in claim 1, wherein said descent means comprises:
a lifeline formed to be attached at one end of the platform; and
a descent governor coupled to said harness for feeding said lifeline at a controlled rate.

5. A personnel survival system as defined in claim 4, wherein said descent means further comprises:
a pocket removably connected to said harness for storing said lifeline.

6. A personnel survival system as defined in claim 5, wherein said descent means further comprises:
a strap connected to said descent governor and removably attached to said harness for maintaining said governor proximate to said harness during the lowering.

7. A personnel survival system as defined in claim 1, wherein said flotation means further comprises:
a pack connected to said raft and to said harness for containing said raft prior to inflation;
means operatively connected to said raft for inflating said raft; and
deployment means coupled to said pack and to said inflating means for sequentially releasing said raft and actuating said inflating means during the lowering.

8. A personnel survival system as defined in claim 7, wherein said deployment means comprises:
a lanyard attachable at one end thereof to the platform and operatively connected along the length thereof to said pack and to said inflating means.

9. A personnel survival system as defined in claim 7, wherein said raft further comprises:
a floor connected to said pack and configured to support the head and torso of the individual;
one of said cells being bifurcated and attached to the periphery of said floor;
the other of said cells being bifurcated and communicatively connected near its ends to either side of said continuous cell at an angle causing said bifurcated cell to urge against said continuous cell, when inflated, proximate to the head of the individual; and
a canopy peripherally attached to said cells and extending in the opposite direction of the inflated bifurcated cell, said canopy being configured to contain the legs of the individual and to cover said floor when said cells are inflated.

10. A personnel survival system as defined in claim 9, wherein said canopy includes a panel of transparent material for permitting the encapsulated individual to view outside.

11. A personnel survival system as defined in claim 9, wherein said raft further comprises:
means attached to said cells for fastening together said cells when inflated;
means connected to the bottom of said floor for ballasting said raft while afloat; and
means connected to the bottom of said floor for stabilizing the direction of said raft while afloat.

12. A personnel survival system as defined in claim 11, wherein said fastening means comprises hook and pile tape.

13. A personnel survival system as defined in claim 7, wherein said pack comprises:
a back panel connected to said harness;
a plurality of folding panels, each of said folding panels being attached to a side of said back panel; and
means operatively connected to said deployment means and to said folding panels for releasably locking said folding panels in a closed position.

14. A flotation device comprising:
a floor configured to support the head and torso of an individual;
an inflatable continuous cell attached to the periphery of said floor;
an inflatable bifurcated cell communicatively connected near its ends to either side of said continuous cell at an angle causing said bifurcated cell to urge against said continuous cell, when inflated, proximate to the head of the individual; and
a canopy peripherally attached to said cells and extending in the opposite direction of the inflated bifurcated cell, said canopy being configured to contain the legs of the individual and to cover said floor when said cells are inflated.

15. A flotation device as defined in claim 14, wherein said canopy includes a panel of transparent material permitting the individual to view outside.

16. A flotation device as defined in claim 14, further comprising:
means operatively connected to said cells for fastening together said cells when inflated;
means connected to the bottom of said floor for ballasting the device when afloat; and
means connected to the bottom of said floor for providing directional stability to the device when afloat.

17. A flotation device as defined in claim 16, wherein said fastening means comprises hook and pile tape.

* * * * *